US009624764B2

(12) United States Patent
Fleckenstein

(10) Patent No.: US 9,624,764 B2
(45) Date of Patent: Apr. 18, 2017

(54) METHOD AND APPARATUS FOR TESTING A TUBULAR ANNULAR SEAL

(71) Applicant: William W. Fleckenstein, Lakewood, CO (US)

(72) Inventor: William W. Fleckenstein, Lakewood, CO (US)

(73) Assignee: Colorado School of Mines, Golden, CO (US)

( * ) Notice: Subject to any disclaimer, the term of this patent is extended or adjusted under 35 U.S.C. 154(b) by 310 days.

(21) Appl. No.: 14/303,240

(22) Filed: Jun. 12, 2014

(65) Prior Publication Data

US 2014/0367094 A1 Dec. 18, 2014

Related U.S. Application Data

(60) Provisional application No. 61/833,995, filed on Jun. 12, 2013.

(51) Int. Cl.
*E21B 47/00* (2012.01)
*E21B 33/16* (2006.01)

(52) U.S. Cl.
CPC ..... *E21B 47/0005* (2013.01); *E21B 33/16* (2013.01)

(58) Field of Classification Search
USPC ..... 166/250.14, 153, 242.1, 70
See application file for complete search history.

(56) References Cited

U.S. PATENT DOCUMENTS 2,120,694 A 6/1938 Crowell
2,735,498 A 2/1956 Muse
3,768,562 A 10/1973 Baker
4,132,111 A 1/1979 Hasha
4,577,689 A * 3/1986 Dotson ..... E21B 49/006 166/250.1
4,694,903 A 9/1987 Ringgenberg
6,401,824 B1 6/2002 Musselwhite et al.
6,679,336 B2 1/2004 Musselwhite et al.
2007/0235186 A1* 10/2007 Sierra ..... E21B 47/06 166/250.07

(Continued)

FOREIGN PATENT DOCUMENTS

EP 0489816 6/1992

OTHER PUBLICATIONS

"American Petroleum Institute. API: Recommended Practice for Performance Testing of Cementing Float Equipment," API Publishing, 2000, pp. 1-7.

(Continued)

*Primary Examiner* — Taras P Bemko
(74) *Attorney, Agent, or Firm* — Sheridan Ross P.C.

(57) ABSTRACT

The present invention provides an apparatus and method for testing a wellbore, and to an apparatus and method to efficiently and effectively test the annular seal of a tubular string positioned within a wellbore. More specifically, the cement seal between a casing string and a wellbore is tested to assure there is no contamination of groundwater or between different geologic formations. An additional aspect of the present invention is to provide a testing assembly comprising a frangible body and a tool body, the tool body providing a passageway to the annular seal when the frangible body is drilled out. In one particular embodiment, the frangible body initially forms an encapsulated bore that aligns with the passageway.

20 Claims, 4 Drawing Sheets

(56) References Cited

U.S. PATENT DOCUMENTS

2012/0168228 A1* 7/2012 Giroux ..... E21B 7/06
175/57

OTHER PUBLICATIONS

King, "Chapter 3: Cementing," George E King Consulting, retrieved from http://gekengineering.com/Downloads/Free_Downloads/Cementing_Chapter_3.pdf, last modified Jun. 11, 2014, 22 pages.

Welge, "Testing Oil and Gas Wells for Water Shutoff with Formation Tester: California Division of Oil and Gas Manual No. M06," California Division of Oil and Gas, 1978, pp. 1-21.

* cited by examiner

METHOD AND APPARATUS FOR TESTING A TUBULAR ANNULAR SEAL

CROSS REFERENCE TO RELATED APPLICATIONS

This application claims the benefit of U.S. Provisional Patent Application No. 61/833,995 entitled "Method and Apparatus for Testing a Tubular Annular Seal" filed on Jun. 12, 2013, the entire disclosure of which is incorporated by reference herein.

FIELD OF THE INVENTION

Embodiments of the present invention are generally related to a method and apparatus for hydrocarbon wellbores and in particular, to a method and apparatus for testing the annular seal of a tubular string of a wellbore.

BACKGROUND OF THE INVENTION

Wellbores drilled for hydrocarbon extraction involve a series of assembly and testing steps before hydrocarbon production may begin. One step requires testing to ensure the integrity of cement used to seal the wellbore casing to the surrounding rock formation. This cement seal prevents communication between producing zones, acquifiers, and any contamination related thereto. Integrity testing traditionally involves water shut-off tests, formation integrity tests, and cement bond logs. Traditional integrity testing means and methods, such as cement bond logs, while generally effective are of significant cost and complexity.

Various efforts have been made to significantly improve wellbore cementing operations. For example, U.S. Pat. No. 6,679,336 to Musselwhite et al. ("Musselwhite") issued Jan. 20, 2004 discloses a float shoe/collar apparatus and method for multi-purpose use in running a tubular string such as a casing string or liner into a wellbore and for optimizing cementing operations. In one embodiment, the apparatus permits auto filling of the tubular string as the string is lowered into the wellbore. Circulation can be effected through down jets for washing the wellbore as necessary. After the tubular string is positioned, the down jets can be blocked off and up jets opened to thereby direct cement upwardly to optimize cement placement. Check valves can also be activated to prevent flow from the wellbore into the tubular string. The apparatus comprises an inner member and tubular member. The inner member is movable upon release of shear pins to cause longitudinal movement relative to the outer member. The movement of the inner member may close a plurality of downward jets and may also open a plurality of upward jets. The apparatus may also be equipped with a set of check valves which can be held open on run in, and subsequently activated to thereby automatically close upon cementing to prevent "u-tubing" of fluid from the annulus back into the casing or other tubing string. However, Musselwhite does not disclose a testing assembly comprising a frangible body and a tool body, the tool body providing a passageway to the annular seal when the frangible body is drilled out. Musselwhite is incorporated herein by reference in its entirety.

European Patent No. EP0489816 to Mueller et al. ("Mueller") issued Jun. 17, 1992 and discloses a ported float shoe and a landing collar attached at a first end of a portion of a casing string and a sliding air trapping insert attached at the other end. The air trapping insert includes a fluid flow passageway blocked by a plug attached by shear pins to the insert or having a conduit providing a fluid passageway to the first end. The air trapping insert and float shoe form an air cavity within the string portion. The air cavity provides buoyant forces during running, cementing or other casing operations within a borehole, reducing running drag and the related chance of a differentially stuck casing. However, Mueller does not disclose a testing assembly comprising a frangible body and a tool body, the tool body providing a passageway to the annular seal when the frangible body is drilled out. Mueller is incorporated herein by reference in its entirety.

U.S. Pat. No. 2,120,694 to Crowell ("Crowell") issued Jun. 14, 1938 discloses a means for cementing oil wells, principally to shut out water, as well as to support and protect the casing. Crowell discloses a specialized valve to perform three functions; a float valve to float the casing in, as part of a cementing plug to actuate valve means to open lateral ports through the wall of the casing, and to close the bore through the casing below said lateral port and thus deflect the cementing mixture there-through. Crowell does not disclose a testing assembly comprising a frangible body and a tool body, the tool body providing a passageway to the annular seal when the frangible body is drilled out. Crowell is incorporated herein by reference in its entirety.

U.S. Pat. No. 2,735,498 to Muse ("Muse") issued Feb. 21, 1956 discloses a subsurface well bore apparatus adapted to form part of a conduit string, such as a casing, liner or drill pipe string, as it is lowered through fluid in the well bore. Muse does not disclose a testing assembly comprising a frangible body and a tool body, the tool body providing a passageway to the annular seal when the frangible body is drilled out. Muse is incorporated herein by reference in its entirety.

U.S. Pat. No. 3,768,562 to Baker ("Baker") issued Oct. 30, 1973 discloses a full opening cementing tool suitable for cementing an oil well Baker utilizes a cylindrical housing, a sliding valve sleeve within the housing, and an opening positioner and a closing positioned located on a pipe string within the casing for actuating the sliding valve sleeve. Other tools such as isolation packers and circulating valves may be used in conjunction with one or more of the cementing tools. Baker does not disclose a testing assembly comprising a frangible body and a tool body, the tool body providing a passageway to the annular seal when the frangible body is drilled out. Baker is incorporated herein by reference in its entirety.

U.S. Pat. No. 4,132,111 to Hasha ("Hasha") issued Jan. 2, 1979 discloses a body having a longitudinal opening provided with longitudinally spaced, annular seal means. The body is provided with passage means for conducting fluid to move the seal means radially of the body opening to seal against tubular members in the body opening. The tubular members are connected together by suitable means such as a coupling, weld, or other arrangement prior to positioning the connection between the seal means. After the seal means has sealed off the connection there between, the body includes additional passage means for conducting fluid pressure to increase the fluid pressure externally of the connection to a pressure significantly greater than the internal pressure to externally test the connection by instrumentally or visually detecting any resultant inflow of the pressurized external fluid. Where the method is employed for leak testing a thread-connected, multiple seal pipe joint having at least one internal and at least one external sealing arrangement, the connection between the tubular members may be only partially made up to a predetermined condition at which a primary or initial internal seal is established in the connection without engaging the external seal. After the joint has been externally tested in this condition, the test seals may be withdrawn from the tubular member and the connection completed to full make-up torque, and the joint again externally sealed and fluid pressure applied to externally test the connection. Hasha, however, does not disclose a testing assembly comprising a frangible body and a tool body, the tool body providing a passageway to the annular seal when the frangible body is drilled out. Hasha is incorporated herein by reference in its entirety.

U.S. Pat. No. 4,694,903 to Ringgenburg ("Ringgenberg") issued Sep. 22, 1997 discloses a tubing tester valve of the present invention comprises a tubular housing assembly having a downwardly closing, spring biased flapper valve. A tubular mandrel assembly is disposed within the housing assembly below the flapper valve, and is secured to the housing assembly with shear pins. The tubing tester valve may be permanently opened through the application of annulus pressure from the rig floor to the annulus surrounding the pipe string, which pressure moves the mandrel assembly upward to rotate the flapper valve to an open position. In order to assure that the mandrel assembly does not retract downwardly, thus permitting the flapper valve to reclose, a spring biased locking means is provided to hold the mandrel assembly in its "up" position. However, Ringgenberg does not disclose a testing assembly comprising a frangible body and a tool body, the tool body providing a passageway to the annular seal when the frangible body is drilled out. Ringgenberg is incorporated herein by reference in its entirety.

U.S. Pat. No. 6,401,824 to Musselwhite, et al. ("Musselwhite") issued Jun. 11, 2002 discloses an improved float shoe/collar apparatus is provided for use during casing run in or floated in. The apparatus has an inner tubular member and outer tubular member, movable upon release of shear pins to cause longitudinal movement relative to each other. The movement of the inner tubular member closes a plurality of downward jets and opens a plurality of upward jets. The apparatus also is equipped with a set of check valves, held open on run in, and activated to close upon cementing to prevent "u-tubing" of fluid back into the casing. Musselwhite does not disclose a testing assembly comprising a frangible body and a tool body, the tool body providing a passageway to the annular seal when the frangible body is drilled out. Musselwhite is incorporated herein by reference in its entirety.

What is needed is an apparatus and method for testing the sealing integrity of wellbores, and particularly an apparatus and method to efficiently and effectively test the annular seal of a tubular string positioned within a wellbore. In one embodiment of the invention, an apparatus and method are disclosed which allow direct testing of the hydraulic annular seal of casing without the use of a cement bond log ("CBL"). In one embodiment, surface casing could be tested for an annular seal in a fraction of the time and expense of the use of cement bond logs. It has been estimated in a report for the Western Energy Alliance that proposed cement bond log regulations by the BLM would cost over $140,000 per well in direct costs and lost rig time. In contrast, the use of one embodiment of the present invention could test the seal of the annulus of a casing for a fraction of this cost.

SUMMARY OF THE INVENTION

It is one aspect of the present invention to provide an apparatus and method for testing a wellbore, and more specifically an apparatus and method to efficiently and effectively test the annular seal of a tubular string positioned within a wellbore. More specifically, the cement seal between a casing string and a wellbore is tested to assure there is no contamination of groundwater or between different geologic formations. An additional aspect of the present invention is to provide a testing assembly comprising a frangible body and a tool body, the tool body providing a passageway to the annular seal when the frangible body is drilled out. In one particular embodiment, the frangible body initially forms an encapsulated bore that aligns with the passageway.

In one embodiment of the invention, a downhole casing assembly adapted for positioning and testing the cement integrity within a wellbore is disclosed, the assembly comprising: a testing assembly body having an interior surface defining a cavity and at least one aperture extending through the body to an exterior surface; a frangible body positioned within the testing assembly body and comprising material adapted to seal the at least one aperture; and wherein a passageway is created between the cavity and the exterior surface of the testing assembly when the frangible body is substantially removed.

In another embodiment of the invention, a method for testing a sealing integrity of a targeted tubular annular seal of a wellbore is disclosed, the method comprising: providing a casing and testing assembly, the assembly comprising a testing assembly body having an interior surface defining a cavity and at least one aperture extending through the body to an exterior surface, and a frangible body positioned within the testing assembly body and comprising material adapted to seal the at least one aperture; positioning the assembly adjacent the targeted tubular annular seal of the wellbore, the assembly positioned below a landed cement plug, the wellbore comprising a casing interior and a casing annulus; drilling through the landed cement plug and through the interior of the assembly to create a passageway to the casing annulus via the at least one aperture of the assembly; wherein pressure and fluid communication between the casing interior and the casing annulus is enabled; and testing the sealing integrity of the targeted tubular annular seal to assure a cement seal is formed in the tubular annulus.

The term "wellbore" and variations thereof, as used herein, refers to a hole drilled into the earth's surface to explore or extract natural materials to include water, gas and oil.

The term "casing" and variations thereof, as used herein, refers to large diameter pipe that is assembled and inserted into a wellbore and typically secured in place to the surrounding formation with cement.

The term "float valve", "casing float valve", and "float collar" and variations thereof, as used herein, refers to valves that allow flow in one direction (typically down the tubular) but not the other, to include autofill floats and ball floats.

The term "tubular string" and variations thereof, as used herein, refers to an assembled length of pipe, to include jointed pipe and integral tubular members such as coiled tubing, and which generally is positioned within the casing.

The term "frangible material" and variations thereof, as used herein, refers to any material tending to break into fragments when a force is applied thereto, to include cement, plastic, composite or other similar drillable material.

This Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claim set forth herein, taken in conjunction with this Summary of the Invention, define the invention.

BRIEF DESCRIPTION OF THE DRAWINGS

The accompanying drawings, which are incorporated in and constitute a part of the specification, illustrate embodiments of the invention and together with the general description of the invention given above, and the detailed description of the drawings given below, serve to explain the principals of this invention.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1A:
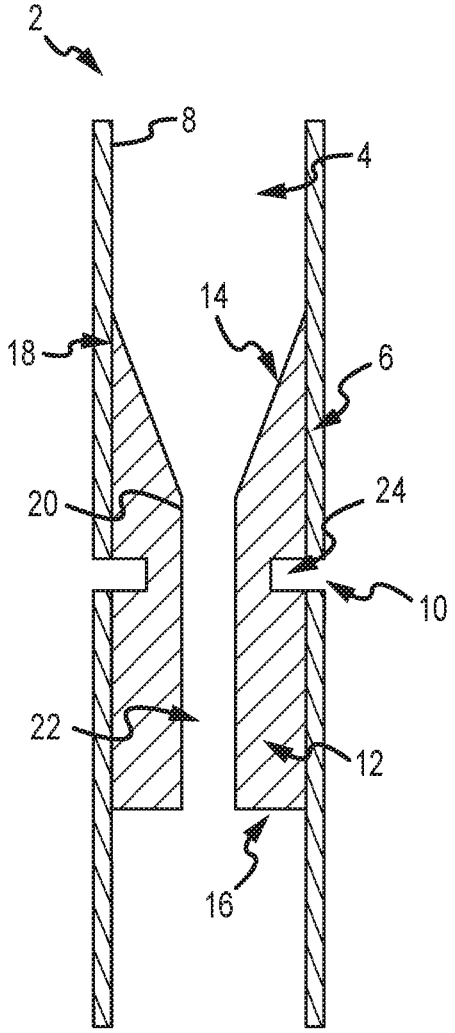
FIG. 1A depicts a front elevation sectional view of a testing assembly according to one embodiment of the present invention.
Figure 1B:
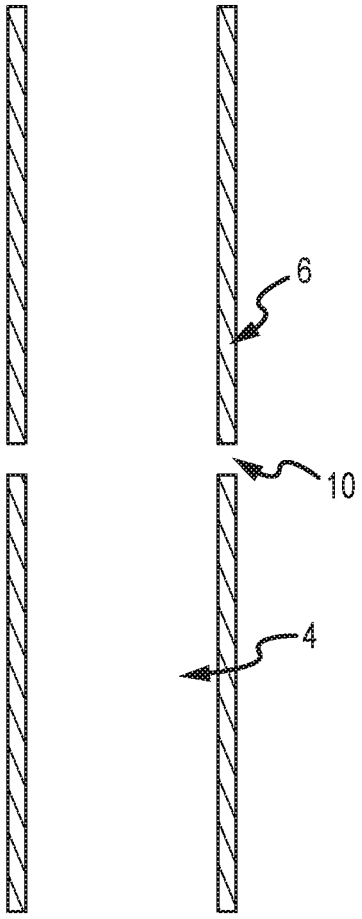
FIG. 1B depicts a front elevation sectional view of the testing assembly of FIG. 1A after removal of the testing assembly frangible body portion according to one embodiment of the present invention.
Figure 2:
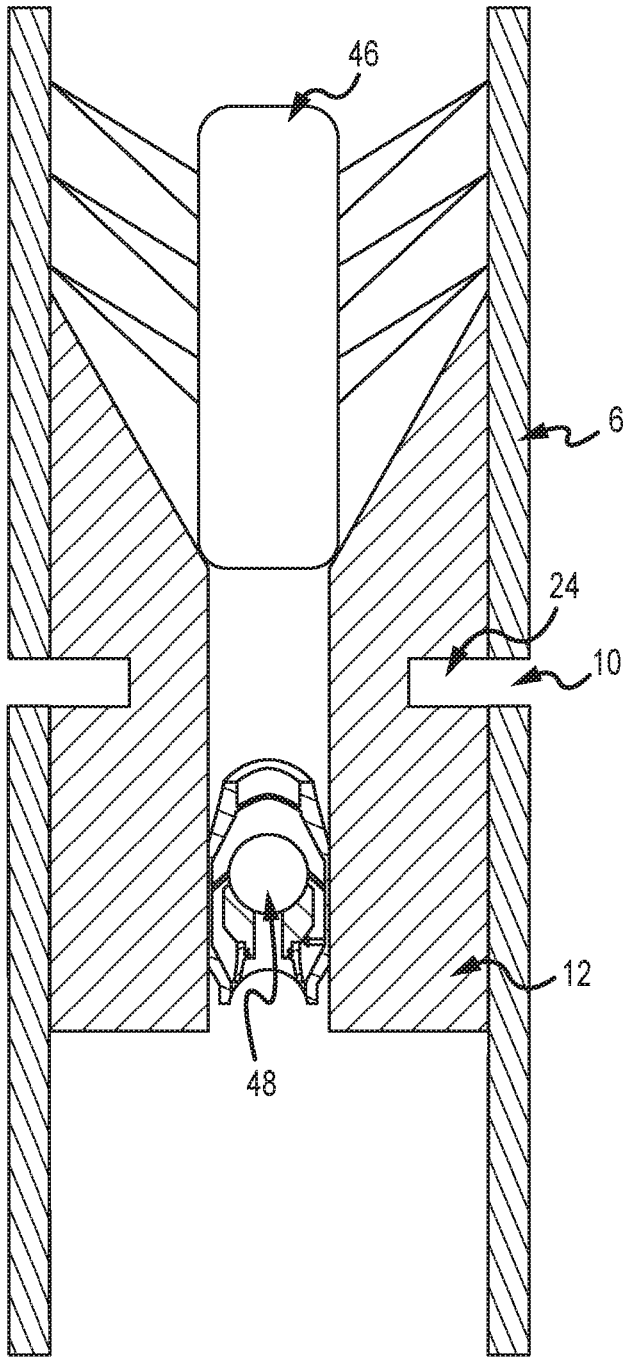
FIG. 2 is a detailed front elevation sectional view of the testing assembly of FIG. 1A with additional wellbore components according to one embodiment of the present invention.

FIGS. 1A-B and 2 and 3B-C depict cross-sectional views of a Testing Assembly 2 according to one embodiment of the present invention. FIG. 1A depicts the Testing Assembly 2 as initially installed into a wellbore at a location of interest for annular seal testing. FIG. 1B depicts the Testing Assembly 2 of FIG. 1A after removal of the Testing Assembly Frangible Body 12 portion of the Testing Assembly 2. FIG. 2 is a detailed front elevation sectional view of the testing assembly of FIG. 1A.

Referring now to FIG. 1A, the Testing Assembly 2 forms Testing Assembly Cavity 4. Testing Assembly 2 comprises Testing Assembly Tool Body 6 and Testing Assembly Frangible Body 12. Testing Assembly Tool Body 6 comprises Testing Assembly Tool Body Interior Surface 8 and Testing Assembly Tool Body Aperture 10. Testing Assembly Frangible Body 12 forms Testing Assembly Frangible Body Inner Cavity 22 and comprises Testing Assembly Frangible Body Proximal End 14, Testing Assembly Frangible Body Distal End 16, Testing Assembly Frangible Body Exterior Surface 18, Testing Assembly Frangible Body Interior Surface 20 and Testing Assembly Frangible Body Outer Cavity 24.

Testing Assembly Frangible Body Exterior Surface 18 substantially aligns with and is in substantial contact with Testing Assembly Tool Body Interior Surface 8. Testing Assembly Frangible Body 12 is configured to span across Testing Assembly Tool Body Aperture 10 to form a seal. Testing Assembly Frangible Body Outer Cavity 24 is substantially aligned with Testing Assembly Tool Body Aperture 10.

Generally, the Testing Assembly 2 functions to test the annular seal of a tubular string (e.g. casing or tubing) placed in a wellbore by means of the Testing Assembly Frangible Body Outer Cavity 24, i.e. by allowing communication between the interior and exterior of the casing. The Testing Assembly Frangible Body Outer Cavity 24 is positioned to align axially with the Testing Assembly Tool Body Aperture 10.

The Testing Assembly Frangible Body Outer Cavity 24 is closed to the inside of the tubular string (area radially exterior or outside the Testing Assembly Tool Body 6) and is configured or constructed so that when the Testing Assembly Frangible Body 12 is destructively removed by drilling or other similar means (resulting in the configuration depicted in FIG. 1B), a passageway is open to the annulus of the casing on the tubular string. That is, a passageway between Testing Assembly Cavity 4 through Testing Assembly Tool Body 6 via Testing Assembly Tool Body Aperture 10 is created. The passageway allows testing of the annular seal of a casing string placed in a wellbore. For example, the testing may comprise assessing the degree of hydraulic seal of the annulus by either positive or negative pressure testing. The removal of the Testing Assembly Frangible Body 12 may be by any means known to one of ordinary skill in the art, to include drilling and milling. The Testing Assembly Tool Body Aperture 10 may comprise a pre-drilled hole or other aperture known to those skilled in the art. The frangible material of the Testing Assembly Frangible Body 12 may be any material known to those skilled in the art, to comprise cement, plastic, composite or other similar drillable material.

In another embodiment, the Testing Assembly Frangible Body 12 does not comprise a Testing Assembly Frangible Body Outer Cavity 24. That is, the Testing Assembly Frangible Body 12 forms a substantially continuous interconnection with the Testing Assembly Tool Body Interior Surface 8, to include a portion spanning the Testing Assembly Tool Body Aperture 10. In this embodiment, upon the destructive removal of the Testing Assembly Frangible Body 12, a passageway is still opened to the annulus of the tubular string as described above. However, this embodiment requires a drilling tool with sufficient tolerance to remove the Testing Assembly Frangible Body 12 from the inside of the Testing Assembly Tool Body 6 to create the aforementioned passageway. The passageway created is between the Testing Assembly Cavity 4 through the Testing Assembly Tool Body 6 via the Testing Assembly Tool Body Aperture 10, and enables a specified positive or negative pressure test of the annulus.

In one embodiment, a plurality of Testing Assemblies 2 are employed in a given wellbore 26. Such a configuration allows integrity testing of casing to occur at multiple locations within a tubular string. A given Testing Assembly 2, in isolation or as part of a plurality of Test Assemblies 2, may be positioned at any targeted location of the wellbore 26. In one embodiment, a plurality of Testing Assemblies 2 are employed at different predetermined depths in the wellbore, each with a potentially different configuration. For example, a first Testing Assembly 2 may comprise a Testing Assembly Frangible Body 12 of different composition than a second Testing Assembly Frangible Body 12, thereby providing different properties during drill-through. Such a distinction provides feedback to the drilling operator and may be used as a positive indicator of engaging a particular Testing Assembly 2.

The Testing Assembly Tool Body 6 may be interconnected to tubular members of a larger tubular string by any means known to those skilled in the art, to include a threaded connection and a welded connection. The tubular members of the tubular string may comprise, for example, jointed pipe and an integral tubular member such as coiled tubing.

In one embodiment, the Testing Assembly Tool Body 6 is adaptable such that it is configured to be incorporated into a pre-existing joint of pipe. For example, the Testing Assembly Tool Body 6 could be incorporated or interconnected to casing or at the connection or collar such as exists in so-called "API" connections or other commonly used tubular connections, in a manner similar to an insert float, as would be readily apparent to one of ordinary skill in the art.

In another embodiment, the Testing Assembly 2 is constructed by pouring of cement or other encapsulating material so as to harden into an adapted casing collar with the required opening through the tubular wall as necessary for the testing of the annular seal. The Testing Assembly 2 may be placed anywhere in an entire length of a tubular string.

In one preferred embodiment, the Testing Assembly 2 is positioned or disposed at or below the casing cementing collar, and above the casing shoe or bottom of the tubular string. In this embodiment, the casing or other tubular may be cemented into the wellbore during a process commonly called a primary cement job. At the end of the primary cementing process, the Testing Assembly 2 is surrounded with liquid cement in both the annulus of the tubular string, and throughout its interior. The interior of the casing is then drilled out, including the Testing Assembly Frangible Body 12, to open the testing Assembly Tool Body Aperture 10.

In another embodiment, the Testing Assembly 2 is positioned or disposed at or above the casing cementing collar, so as to allow testing of an annular seal at a relatively higher depth of interest. For example, a Testing Assembly 2 located adjacent a particular fresh water aquifer would allow additional testing of a cement seal between a surface casing and the aquifer.

In another embodiment, the Testing Assembly 2 is employed as part of a "leak-off" test to distinguish a pressure level required to trigger fluid entering the open formation versus that to trigger fluid compromising the production casing. Generally, a leak-off test is used to determine the pressure at which fluid will enter an open formation after drilling below the casing shoe. Fluid pressure is gradually increased until a pressure drop is observed, assumed to indicate that the fluid has entered, i.e. leaked into, the formation. This fluid pressure sets the maximum pressure that may be applied to the well during drilling operations. However, it is possible that the pressure drop may instead be caused by a leak in the production casing rather than fluid entering the formation. In order to distinguish or at least bound these two scenarios, the Testing Assembly 2 may be positioned in the production casing above the casing shoe and used, as previously described, to assess/test the integrity of the production casing cement, prior to conducting a conventional leak-off test.

In another embodiment, the Testing Assembly 2 may be directly incorporated into the construction of the casing cementing collar, which also may be designed to work as any type of float collar or Float Valve 48 as depicted in FIG. 2. More specifically, the liquid cement is allowed to set and harden around the casing, by maintaining the casing in a static position. This is as customary during a primary casing or liner cement job. When enough time has elapsed, normally called the WOC or the Waiting on Cement time (which may be judged as sufficient by the time it takes for the cement to reach 500-1000 psi compressive strength), the bottom of the casing can be drilled out with normal drilling tools, and the well construction process continued.

Figures 3A, 3B, 3C:
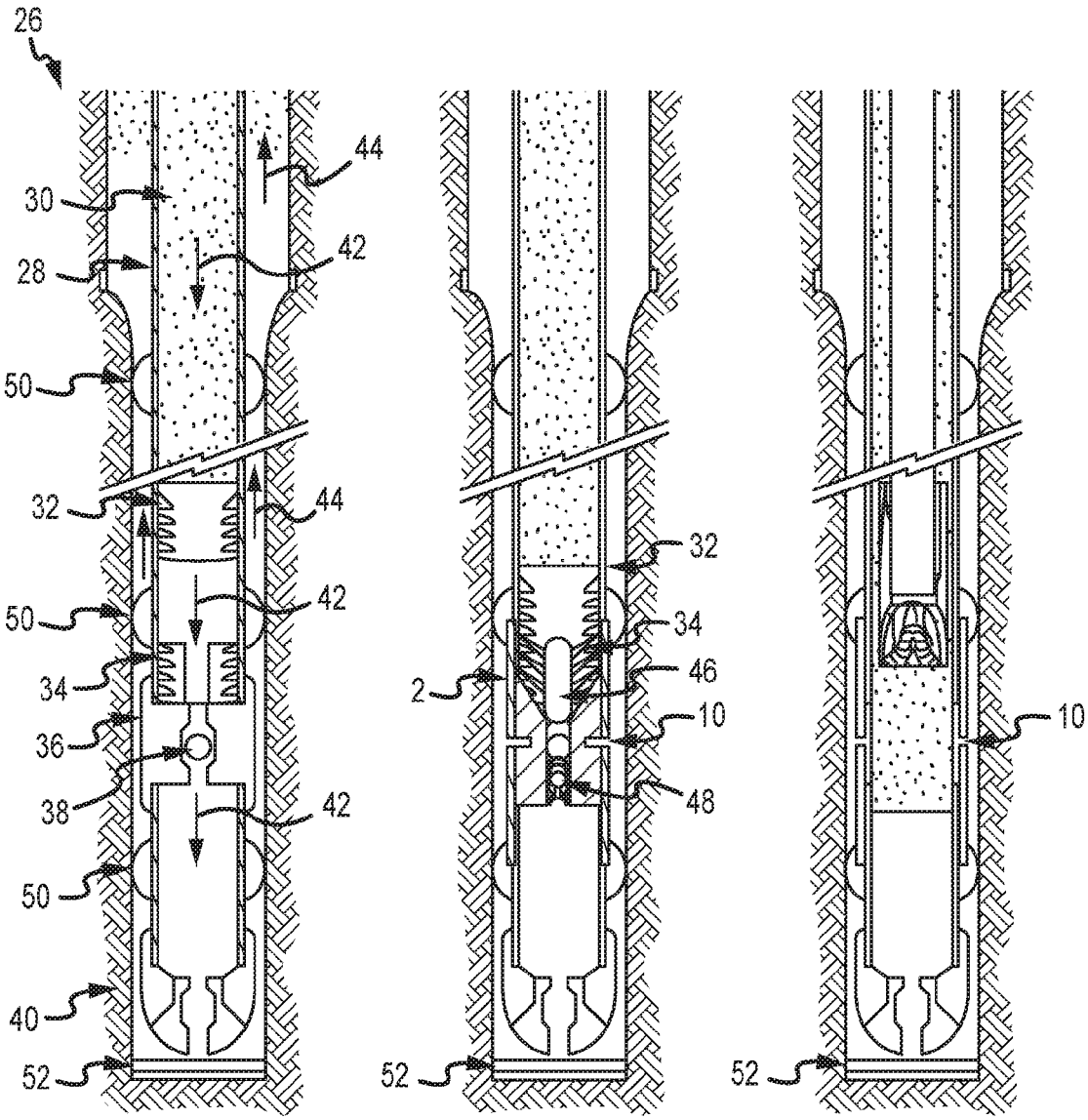
FIG.3A (PRIOR ART)
FIG. 3A depicts a front elevation sectional view of a wellbore with conventional float collar according to the prior art.
FIG. 3B depicts a front elevation sectional view of a wellbore with installed testing assembly according to one embodiment of the present invention.
FIG. 3C depicts a front elevation sectional view of a wellbore with installed testing assembly of FIG. 3B after removal of the testing assembly frangible body portion according to one embodiment of the present invention.

FIG. 3A depicts a front elevation sectional view of a Wellbore 26 with Traditional Casing Float Collar 38 according to the prior art. FIG. 3B depicts a front elevation sectional view of a Wellbore 26 with installed Testing Assembly 2 of FIG. 1A according to one embodiment of the present invention. FIG. 3C depicts a front elevation sectional view of a Wellbore 26 with installed Testing Assembly 2 of FIG. 3B after removal of the Testing Assembly Frangible Body 12 according to one embodiment of the present invention.

FIG. 3A depicts a front elevation sectional view of a Wellbore 26 with Traditional Casing Float Collar 38 according to the prior art. In particular, FIG. 3A depicts a well construction primary cementing process during displacement of the cement through the end of the job, using a Traditional Casing Float Collar 38. Generally, during the cementing process, cement is provided to Casing 28 comprising Casing Interior 30, the cement flowing within interior as Casing Cement Flow 42 and engaging Cement Plug One 32, Cement Plug Two 34 and Traditional Casing Float Collar 38. Cement flows downward in the casing, and upward in the annulus, to create a seal between the Casing 28 and Wellbore 26.

FIG. 3B depicts the substitution of the Testing Assembly 2 for the Traditional Casing Float Collar 38. In FIG. 3B, the Wellbore 26 is depicted when both Cement Plug One 32 and Cement Plug Two 34 of FIG. 3A have landed therein forming Landed Cement Plug 46.

In one embodiment of a method of use of the Testing Assembly 2, the primary cement job is pumped in the customary manner as provided in FIG. 3A, with Testing Assembly 2 in the position of the Traditional Casing Float Collar 38 and performing the Traditional Casing Float Collar 38 normal functions of preventing the heavier cement column in the annulus when displacement stops from flowing back into the Casing 28. The Testing Assembly 2 also functions as a stop for the cementing plugs 32, 34 in the Casing 28, providing an indication at the surface by an increase in pressure when the respective plugs land, indicating the position of the cement slurry.

It will be appreciated by one of skill in the art that the placement of the Testing Assembly 2 in this position may shield the Testing Assembly 2 from the higher differential pressure across the cement plugs customarily observed at the end of pumping the primary cement job, a process commonly called "bumping the plug". Furthermore, the Testing Assembly 2 may be placed anywhere in the Wellbore 26. In particular, the Testing Assembly 2 may be positioned at or below the position depicted in FIG. 3B, relative to the referenced placement of the Traditional Casing Float Collar 38. In such a configuration, the pressure exerted on the inside and exterior of the Testing Assembly 2 will be nearly identical, and will be a function of the hydrostatic pressure of the cement.

In another embodiment, the Testing Assembly 2 is placed within 10 feet of the cement shoe, or at any user-selected position above the cement shoe as identified for optimal testing of the annular seal, and have a conventional cement collar above the Testing Assembly 2 in its normal position in the casing string. Such a configuration positions the Testing Assembly 2 in an optimal position or positions to test the set cement hydraulic seal around the Casing 28, and prove that the formations above, such as fresh water aquifers, are protected from migration of fluid in the casing annulus.

In another embodiment, the Testing Assembly 2 may be employed with a conventional ported casing collar as known to those skilled in the art; however, this may cause the cement to be contaminated in the casing annulus near the ports if the cement is over displaced. In addition, the ports are always open to flow of cement during circulation of the cement, and may only prove that the cement has set up in the ports. Still, it is contemplated that the method of use of the Testing Assembly 2 could be practiced by the use of prior art ported casing collars.

After the cement has set up in the Wellbore 28, the bottom portion of the casing string must be drilled out, including the Testing Assembly Frangible Body 12 and any other cementing equipment placed in the casing string, such as cementing plugs, float collar and float shoe. During this process, the interior of Testing Assembly 2 will also be drilled out, opening the Testing Assembly Frangible Body Outer Cavity 24, which allows pressure and fluid flow communication between the interior of the Casing 28 and the annulus of the Casing 28 at the Targeted Annulus Testing Site 36. This is the configuration depicted in FIG. 3C.

Note that the bottom of the Casing 28 is still blocked by the presence of the set cement. To practice this invention, it is important to determine the location of the Testing Assembly 2 in the Casing 28 during drill out operations. In one embodiment, the Testing Assembly Frangible Body 12 material is designed such that when set it is materially harder to drill than the cement used during the primary cement job. This would give an indication at the surface that the passageway through the Testing Assembly Frangible Body Outer Cavity 24 and the Testing Assembly Tool Body Aperture 10 are open.

If the Testing Assembly Frangible Body 12 material is cement, this cement could be made of a much higher compressive strength than the cement used for cementing operations. If the testing Assembly 2 is to be used on the tubular string commonly called the surface casing, then a preferred method would use the measured length of the drill pipe to accurately determine what distance would be needed to drill several feet past the tool, prior to testing operations. Surface casing is normally between several hundred to several thousand feet of the surface, which easily is within the accuracy of the drill pipe measurement methods currently in use on drilling rigs.

Once the passageway to the annulus is opened by the drilling cleanout operations described above, a blowout preventer can be closed to seal the wellbore annulus at the surface. Then, the annular seal can be pressure tested by increasing the pressure in the wellbore to a prescribed pressure, such as by a Formation Integrity Test (FIT), a well-known technique. This approach enables a positive test that the annular is filled with cement, and that no channels exist that will allow migration past that point in the wellbore. This has great advantages over conducting a conventional FIT below the casing shoe to prove the casing annulus is effectively sealed, because, for example, the FIT test is testing the leak off into the formation below the casing shoe, and may be inconclusive as to proving the seal around the casing, such as in the case of natural occurring fractures in the formation or the presence of a higher permeable formation below the casing shoe. Such situations may falsely indicate that the annular seal is leaking during testing operations. Once the pressure test is completed (in a matter of minutes), the cement cleanout continues, and very little time is expended prior to drilling the next section of the wellbore. If the pressure test fails, the invention could be used to squeeze cement into the annulus and seal against migration.

A negative pressure test may also be performed using the Testing Assembly 2. A negative pressure test would first involve cleaning out the casing interior to expose the passageway to the annulus. Next, the customary tools to perform a water-shut off test would be run into the wellbore. This process is well known in the industry and is described in great detail in the California Division of Oil and Gas (DOG) publication titled "Testing Oil and Gas Wells for Water Shutoff with a Formation Tester."

In other embodiments, the Testing Assembly Tool Body Aperture 10 is drilled after the Testing Assembly Tool Body 6 is constructed. In another embodiment, the Testing Assembly Tool Body Aperture 10 is pre-drilled into the Testing Assembly Tool Body 6, and plastic tubes are installed to provide a space so that the frangible encapsulating material (such as cement) could be poured and then hardened.

Figure 4:
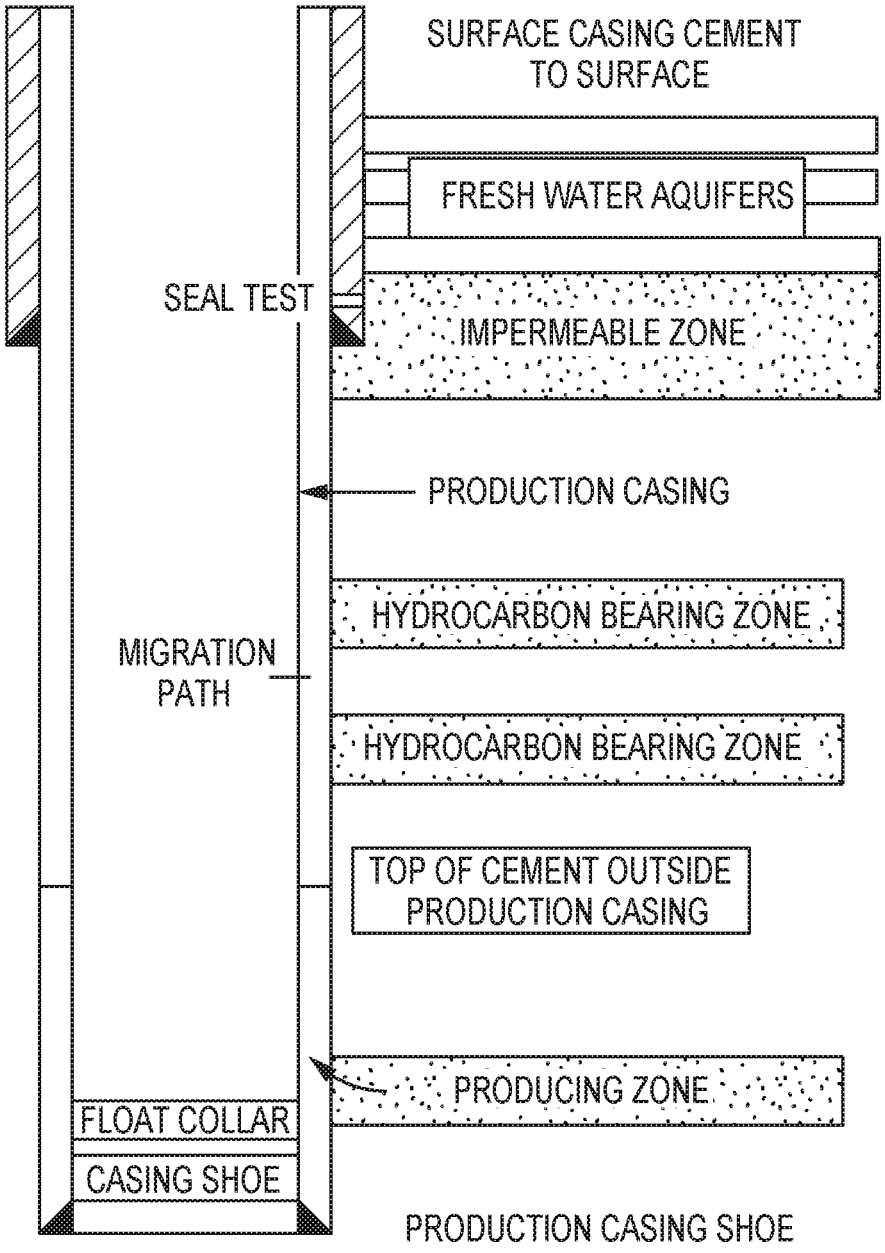
FIG. 4 depicts a front elevation sectional view of a pictorial representation of a wellbore prepared for integrity testing.

The overall testing procedure for testing the sealing integrity of an annular seal of a tubular string of a wellbore may be better understood in reference to the following illustrative example, which should not be construed as limiting the functional and operational characteristics of the Testing Assembly 2. The testing procedure is described with reference to FIG. 4, which depicts a front elevation sectional view of a pictorial representation of a wellbore prepared for integrity testing. FIG. 4 details a Wellbore 26 drilled from the surface to a producing zone. Wellbore 26 passes through several formation zones. Specifically, wellbore 26, as descending from the surface, passes through fresh water aquifers, an impermeable zone (e.g. hard rock, shale, impermeable clay), and one or more hydrocarbon bearing zones, to include a targeted producing zone. Surface casing cement is shown to run from the surface through the fresh water aquifers and partially into the impermeable zone. Surface casing typically runs to approximately 2000 ft below the surface. Production casing is shown with cement running from the production casing shoe up through targeted producing zone and stop below a lower hydrocarbon bearing zone. A targeted location within the impermeable zone for integrity seal testing is depicted.

The sealing integrity (positive) test proceeds as follows:

1. Assuming the invention is placed within ten (10) feet of the cement shoe, after the cement has set up in the wellbore, the cement in the bottom of the casing string is drilled out with a drill bit or other conventional drilling tool.

2. Drilling continues through cement stringers on top of the cementing plug, through the float collar and through the cement in the casing until the drilling bit is approximately five (5) feet from the invention.
3. The pipe rams, or annular preventer on the blow out preventer is closed, and the casing is pressure tested to a prescribed limit to test the integrity of the casing, while taking care, based on the cement mechanical properties, to avoid cracking the cement sheath surrounding the casing.
4. Once the pressure test is completed, the blowout preventer is opened, circulation is established and drilling continues to clean out the cement until the Testing Assembly 2 is contacted with the drill bit and drilled out to at least a depth to create a passageway to the annulus via the tool body aperture.
5. The Testing Assembly 2 may use a harder cement or other frangible material that is more difficult to drill than the cement that was left in the casing after the cement job. This will give a positive indication that the tool has been drilled through. Since the surface casing is normally relatively shallow, the depth drilled may be calculated using the pipe measurements to confirm that the tool has been drilled through.
6. The blowout preventer is closed and the casing is pressured to a prescribed low pressure at the surface, which is then held and may be recorded to note any pressure bleed off at the surface testing the annular casing seal.
7. If the bleed off is within acceptable limits, the test is deemed a success, the annular seal at the bottom of the casing is confirmed by direct measurement through the ports in the casing exposed by drilling past the tool, and drilling operations may recommence into open hole after drilling the casing shoe.

The sealing integrity (negative) test proceeds as follows:

1. A drill stem test packer is run in the wellbore with the drill pipe evacuated.
2. The packer on the tester is set above the Testing Assembly 2, which has been drilled out and is opened to measure the inflow from the well, in the manner customarily known as a water shutoff test.
3. If the inflow is within acceptable limits customarily associated with water shut off tests, the test of the annular seal is deemed a success, the drill stem test packer is pulled from the hole, and drill operations are restarted using a drilling assembly.

To assist in the understanding of the present invention the following list of components and associated numbering found in the drawings is provided herein:

| Reference No. | Component |
|---|---|
| 2 | Testing Assembly |
| 4 | Testing Assembly Cavity |
| 6 | Testing Assembly Tool Body |
| 8 | Testing Assembly Tool Body Interior Surface |
| 10 | Testing Assembly Tool Body Aperture |
| 12 | Testing Assembly Frangible Body |
| 14 | Testing Assembly Frangible Body Proximal End |
| 16 | Testing Assembly Frangible Body Distal End |
| 18 | Testing Assembly Frangible Body Exterior Surface |
| 20 | Testing Assembly Frangible Body Interior Surface |
| 22 | Testing Assembly Frangible Body Inner Cavity |

-continued

| Reference No. | Component |
|---|---|
| 24 | Testing Assembly Frangible Body Outer Cavity |
| 26 | Wellbore |
| 28 | Casing |
| 30 | Casing Interior |
| 32 | Cement Plug One |
| 34 | Cement Plug Two |
| 36 | Targeted Annulus Testing Site |
| 38 | Traditional Casing Float Collar |
| 40 | Casing Downhole End |
| 42 | Casing Cement Flow |
| 44 | Annulus Cement Flow |
| 46 | Landed Cement Plug |
| 48 | Float Valve |
| 50 | Casing Centralizer |
| 51 | Casing Shoe |

What is claimed is:

1. A downhole casing assembly for testing the cement integrity of a targeted annular seal of a wellbore, comprising:

a testing assembly body for positioning within a tubular string of the wellbore, the testing assembly body having an interior surface defining a cavity and at least one aperture extending through the body to an exterior surface;

a frangible body positioned within the cavity and comprising material adapted to seal the at least one aperture; and wherein a passageway is created between the cavity and the exterior surface of the testing assembly when the frangible body is substantially removed, the passageway extending to an annulus of the wellbore such that pressure and fluid communication from an interior of the tubular string and the annulus is provided to test the cement integrity of the targeted tubular annular seal of the wellbore after the cement has been selectively positioned and cured.

2. The system of claim 1, wherein the frangible body further comprises an outer cavity adapted to align with the at least one aperture.

3. The system of claim 1, wherein the frangible body is comprised of at least one of a cement, a plastic, and a composite material.

4. The system of claim 1, wherein the testing assembly body has a cylindrical shape and is adapted for threadable connection to a tubular member.

5. The system of claim 1, wherein the testing assembly body is positioned below a casing cement collar during a cementing operation to secure the casing within a wellbore.

6. The system of claim 1, wherein the at least one aperture is pre-drilled formed.

7. The system of claim 1, wherein the at least one aperture is a plurality of apertures positioned at substantially equal radii from a centerline of the testing assembly body.

8. The system of claim 1, wherein the frangible body comprises a proximal end configured to receive a cement plug.

9. The system of claim 1, wherein the material of the frangible body is distinct from a cement used during a wellbore primary cement job.

10. The system of claim 1, wherein the frangible material is of greater compressive strength than a cement used during a wellbore primary cement job.

11. The system of claim 1, wherein the tubular annular seal may be disposed at a location other than a cement shoe.

12. The system of claim 1, wherein the testing assembly body has an axial centerline shared with an axial centerline of the casing annulus of the wellbore.

13. A method for testing a targeted tubular annular seal of a wellbore, comprising:

providing a tubular string and testing assembly, the assembly comprising a testing assembly body having an interior surface defining a cavity and at least one aperture extending through the body to an exterior surface, and a frangible body positioned within the cavity and comprising a material adapted to seal the at least one aperture;

positioning the assembly proximate to the targeted tubular annular seal of the wellbore, the assembly positioned below a landed cement plug;

drilling through the landed cement plug and frangible body after cement within the wellbore has cured to create a passageway to the tubular annulus via the at least one aperture of the assembly;

wherein pressure and fluid communication from the interior of the tubular string and the annulus is provided; and testing the pressure integrity of the targeted tubular annular seal to assure a cement seal is formed in the tubular string annulus.

14. The method of claim 13, wherein the targeted tubular annular seal of the wellbore is within an impermeable zone.

15. The method of claim 13, wherein the frangible body further comprises an outer cavity adapted to align with the at least one aperture.

16. The method of claim 13, wherein the testing assembly body has a cylindrical shape and is adapted for threadable connection to a tubular member.

17. The method of claim 13, wherein the at least one aperture is pre-formed.

18. The method of claim 13, wherein the at least one aperture is a plurality of apertures positioned at substantially equal radii from a centerline of the testing assembly.

19. The method of claim 13, wherein a pressure differential is created in the annulus to test integrity of the seal.

20. The method of claim 13, wherein the frangible material is of greater compressive strength than a cement used during a wellbore primary cement job.

* * * * *